US006401260B1

(12) United States Patent
Porth

(10) Patent No.: US 6,401,260 B1
(45) Date of Patent: Jun. 11, 2002

(54) WOBBLING HEADPIECE

(76) Inventor: Timothy Porth, 9121 Forest Hills Cir., Bloomington, MN (US) 55437

( * ) Notice: Subject to any disclaimer, the term of this patent is extended or adjusted under 35 U.S.C. 154(b) by 0 days.

(21) Appl. No.: 09/836,016

(22) Filed: Apr. 17, 2001

(51) Int. Cl.[7] ..... A42B 3/00
(52) U.S. Cl. ..... 2/411; 2/410; 2/416; 2/171
(58) Field of Search ..... 2/411, 171, 6.8, 2/209.13, 416, 418, 420, 410; 446/27

(56) References Cited

U.S. PATENT DOCUMENTS

| | | | | |
|---|---|---|---|---|
| 1,244,559 | A | * 10/1917 | Stocks | |
| 1,251,537 | A | * 1/1918 | Kempny | |
| 2,306,362 | A | * 12/1942 | Wolff | |
| 3,184,757 | A | * 5/1965 | Pennington | |
| 3,237,201 | A | * 3/1966 | Morgan | |
| 4,000,520 | A | 1/1977 | Svendsen et al. | 2/418 |
| 4,023,209 | A | 5/1977 | Frieder, Jr. et al. | 2/6 |
| 4,056,852 | A | 11/1977 | Greendale | 2/417 |
| 4,223,409 | A | 9/1980 | Lee | 2/411 |
| 4,279,037 | A | 7/1981 | Morgan | 2/421 |
| 4,293,960 | A | 10/1981 | Palmaer | 2/416 |
| 4,484,364 | A | 11/1984 | Mitchell et al. | 2/413 |
| 4,488,316 | A | 12/1984 | Mosca | 2/171 |
| 4,942,628 | A | 7/1990 | Freund | 2/416 |
| D311,267 | S | 10/1990 | Pesta | D2/250 |
| 5,204,998 | A | 4/1993 | Liu | 2/411 |
| 5,425,620 | A | 6/1995 | Stroud | 416/63 |
| 5,724,681 | A | 3/1998 | Sykes | 2/425 |
| 5,794,270 | A | 8/1998 | Howat | 2/410 |
| 6,007,212 | A | 12/1999 | Chan | 362/106 |
| 6,076,191 | A | 6/2000 | Kapas | 2/171.02 |
| 6,081,931 | A | 6/2000 | Burns et al. | 2/411 |

* cited by examiner

*Primary Examiner*—Rodney M. Lindsey
(74) *Attorney, Agent, or Firm*—Christopher L. Holt; Westman, Champlin & Kelly, P.A.

(57) ABSTRACT

One aspect of the present invention pertains to a wobbling headpiece that includes a display member having an inner concave portion that substantially surrounds and is substantially disassociated from a head strap. An action mechanism is operably disposed between the display member and the head strap.

19 Claims, 7 Drawing Sheets

WOBBLING HEADPIECE

BACKGROUND OF THE INVENTION

The present invention pertains to headpieces. More specifically, the present invention pertains to a headpiece having moving parts designed to draw attention to those who wear the headpiece.

Different types of headpieces have been used to draw the attention of one or more bystanders to the wearer of a headpiece. Some of these headpieces are designed to draw the attention of bystanders at a particular event or location. For example, attention drawing headpieces that include symbols or items that represent a particular sporting club or athlete are worn by spectators at many sporting events.

There is a very strong market that surrounds the sale of goods having symbols or items that represent sporting clubs or athletes. Accordingly, sporting club owners, and similarly involved entities, have a strong incentive to develop new products that present the spirit of a particular sporting club or athlete in a unique way that is appealing to the public-at-large.

Various headpieces have been designed to attract the attention of bystanders through the incorporation of mechanical and/or electrical elements. For example, headpieces known in the art incorporate battery-operated fans. Other headpieces known in the art incorporate flashing and/or rotating lights. Yet other headpieces known in the art incorporate rotating ornaments. At least one headpiece known in the art incorporates a dangling element designed to dangle mistletoe over the head of a wearer.

In view of the forgoing, there is an on-going need for unique headpieces that appeal to the public-at-large and draw attention to those who wear the headpieces.

SUMMARY OF THE INVENTION

In accordance with one aspect of the present invention, a wobbling headpiece is provided. The wobbling headpiece includes a head strap and a display member having an inner concave portion that substantially surrounds the head strap. The display member and the head strap are substantially disassociated from one another. An action mechanism is operably disposed between the display member and the head strap.

In accordance with another aspect of the present invention, a headpiece is provided. The headpiece includes a connecting member having a top surface. A head strap is connected to the connecting member. A first connection piece is connected to and extends from the top surface of the connecting member. The headpiece further includes a display member that includes an inner concave portion that substantially surrounds and is substantially dissociated from the head strap and the connecting member. A second connection piece slidably receives the first connection piece and is connected to the display member. An action mechanism is operably disposed between the first and second connection pieces.

In accordance with yet another aspect of the present invention, a novelty headpiece is provided. The novelty headpiece includes an action mechanism operably disposed between a display member, having the appearance of an oversized helmet, and a head strap.

DETAILED DESCRIPTION OF ILLUSTRATIVE EMBODIMENTS

Figure 1:
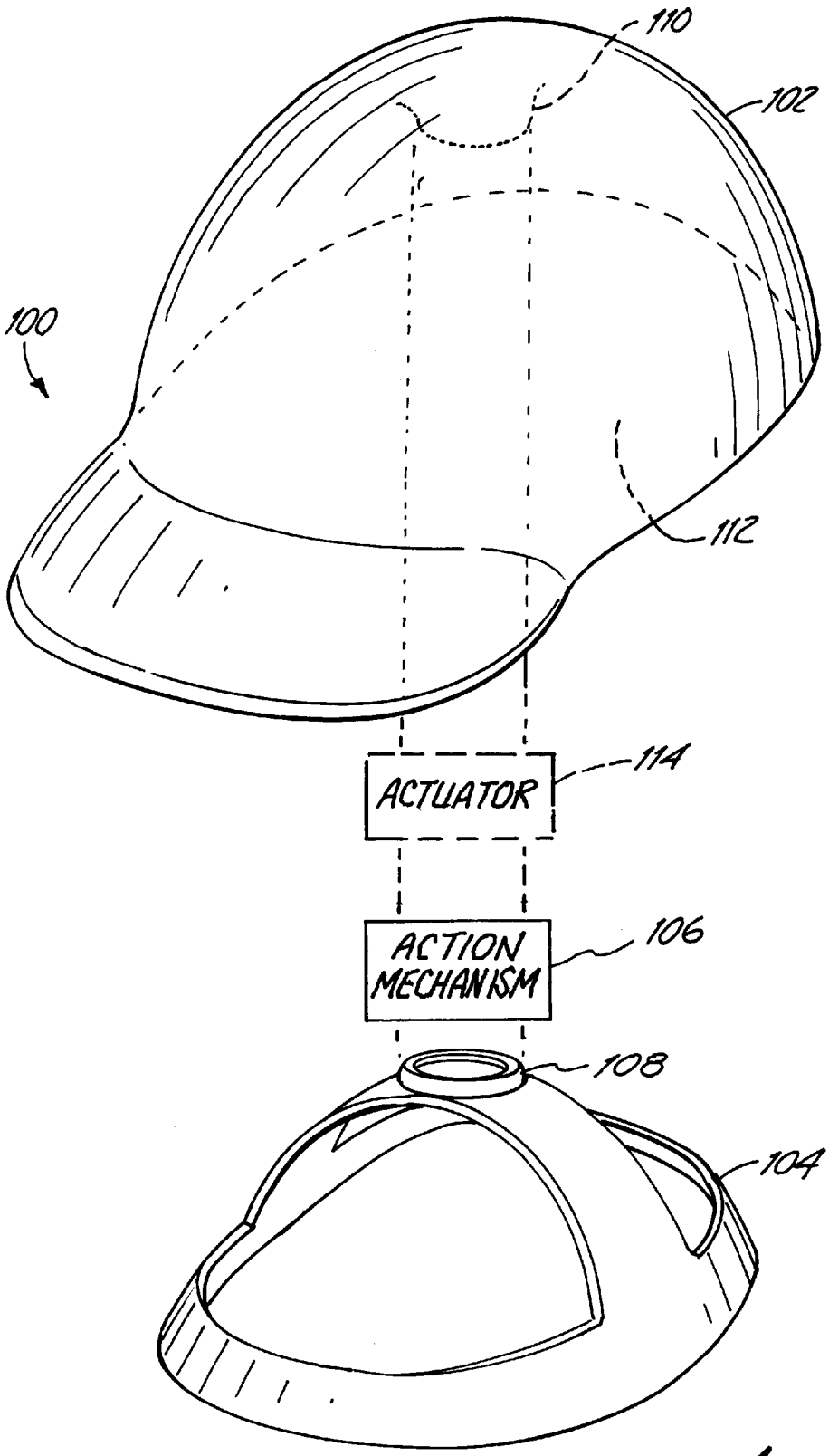
FIG. 1 is a schematic isometric exploded view of a headpiece in accordance with an embodiment of the present invention.

Referring to FIG. 1, a schematic isometric exploded view of a headpiece 100 is illustrated. Headpiece 100 includes a display member 102, head strap 104 and action mechanism 106.

In accordance with embodiments of the present invention, display member 102 could take on forms other than the appearance of a baseball helmet depicted in FIG. 1. For instance, display member 102 could illustratively take on forms and have appearances that include but are not limited to a clown hat, a ball cap, a wizard hat, a fireman's hat or a basketball head (a cut away basketball). Consistent with examples described below, display member 102 could be formed having an appearance of a helmet associated with a sport other than baseball. Illustratively, display member 102 could alternatively take the form of a simulated portion of a human head, such as a simulated head having the face portion cut away or a simulated hair-style having the rest of the head cut away. Forms other than those specifically listed in this description should be considered within the scope of the present invention.

Display member 102 illustratively includes an inner concave portion 112 and an optional molded element 110 for engaging a portion of action mechanism 106. In accordance with one embodiment of the present invention, when headpiece 100 is completely assembled, inner concave portion 112 substantially surrounds and is substantially disassociated from head strap 104. In accordance with another embodiment, display element 102 is formed as an oversized helmet, substantially larger than a typical helmet designed to snugly fit a wearer's head. Illustratively, the oversized helmet has the appearance of a helmet, but provides few, if any, protective benefits.

Head strap 104 is illustratively designed to comfortably engage the head of one who wears headpiece 100. In accordance with one embodiment, head strap 104 includes a size adjustment mechanism (not illustrated), which allows head strap 104 to be adjusted to comfortably fit heads having various sizes and shapes. Head strap 104 illustratively includes an optional molded element 108 for engaging a portion of action mechanism 106.

Schematically depicted in FIG. 1, action mechanism 106 is designed to interconnect or operably engage display member 102 and head strap 104. Action mechanism 106 is illustratively designed to allow display member 102 to move (i.e., wobble, bounce, slide, etc.) relative to head strap 104 and relative to the head of one who wears headpiece 100. In accordance with one embodiment, action mechanism 106 is a ball and socket connection between head strap 104 and display member 102. Action mechanism 106, however, could be any of a number of mechanisms capable of enabling wobbling, bouncing or other similar motion. Mechanisms that could be utilized as action mechanism 106 include, but are not limited to, a spring (i.e., a coil spring or leaf spring), elastically suspended straps, or a flexible material (i.e., sponge-like material, rubber, a flexible polymeric material, flexibly constructed metal, plastic, flexible wood, etc.). In accordance with other embodiments, action mechanism 106 is integrally formed with either display member 102 or head strap 104.

In accordance with one embodiment of the present invention, headpiece 100 includes an optional actuator 114. Optional actuator 114 is illustratively a motor and is operably disposed relative to action mechanism 106, or relative to head strap 104 and display member 102, so as to enable an automatic wobbling, bouncing or other similar motion of display member 102 relative to head strap 104. While optional actuator 114 is depicted as being positioned between action mechanism 106 and display member 102, it could be positioned between action mechanism 106 and head strap 104 without departing from the scope of the present invention. It could also be positioned within or inside bouncing mechanism 106. In accordance with one embodiment, optional actuator 114 is attached to display member 102 on a surface of inner concave portion 112 so as to be operably disposed relative to action mechanism 106. Examples of optional actuator 114 devices include motor-driven linear and rotational mechanical actuators. Other actuators could be utilized without departing from the scope of the present invention. The actuators could illustratively produce either a consistent or random pattern of motion.

Figure 2:
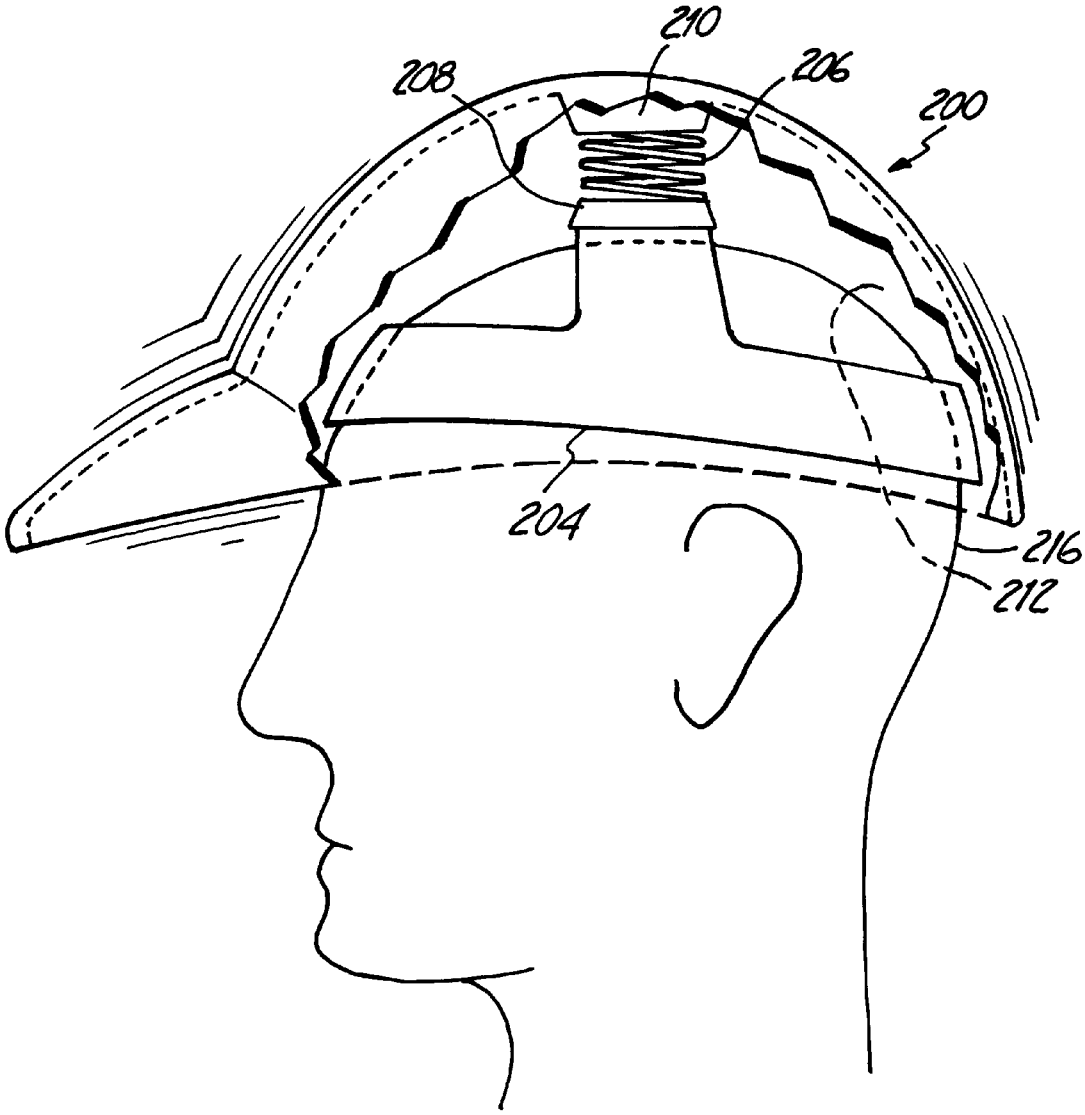
FIG. 2 is a side elevational view, partially broken away, of a headpiece in accordance with an embodiment of the present invention.

Turning to FIG. 2, a side elevational view of an assembled headpiece 200 in accordance with an embodiment of the present invention is illustrated and is illustratively partially broken away to expose components of the present invention. Similar numbers are used in FIG. 2 for elements that are the same or similar to elements illustrated in the previously described embodiment. Headpiece 200 is illustratively shown being worn on a head 216.

Headpiece 200 includes a display member 202 connected to a head strap 204 by an action mechanism 206. Display member 202 includes a concave portion 212 that substantially surrounds and is substantially disassociated from head strap 204. Display member 202 and head strap 204 respectively include optional molded elements 210 and 208 for receiving and supporting portions of action mechanism 206. In accordance with an embodiment of the present invention, when head 216 is moved, display member 202 is caused to wobble/bounce relative to head strap 204 and head 216.

It should be pointed out that while display member 202 is depicted as having the appearance of a baseball helmet and action mechanism 206 is depicted as a spring, other configurations, several examples of which are described in relation to FIG. 1, should be considered within the scope of the present invention.

Figure 3:
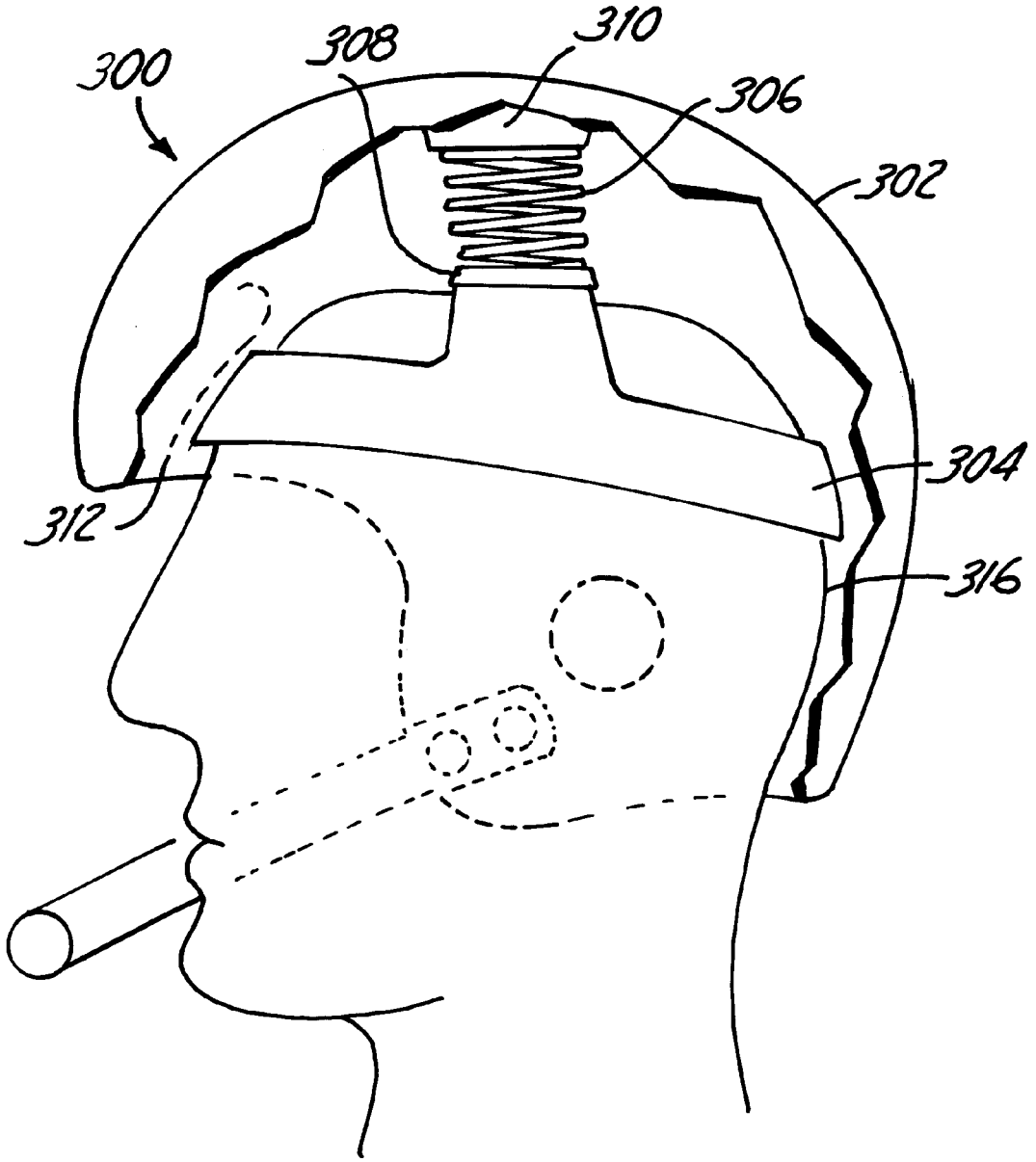
FIG. 3 is a side elevational view, partially broken away, of a headpiece in accordance with an embodiment of the present invention.

Turning to FIG. 3, a side elevational view of a headpiece 300 illustratively positioned upon a head 316, in accordance with another embodiment of the present invention is illustrated and is illustratively partially broken away to expose internal components. Similar numbers are used in FIG. 3 for elements that are the same or similar to elements illustrated in the previously described embodiments. Headpiece 300 includes a display member 302, head strap 304, action mechanism 306, optional molded elements 308 and 310, and inner concave portion 312, which are similar to comparable items in the previously described embodiments. In accordance with the FIG. 3 embodiment, display member 302 is formed as having the appearance of a football helmet. It should be pointed out that while action mechanism 306 is depicted as a spring, other configurations, several examples of which are described in relation to FIG. 1, should be considered within the scope of the present invention.

Figure 4:
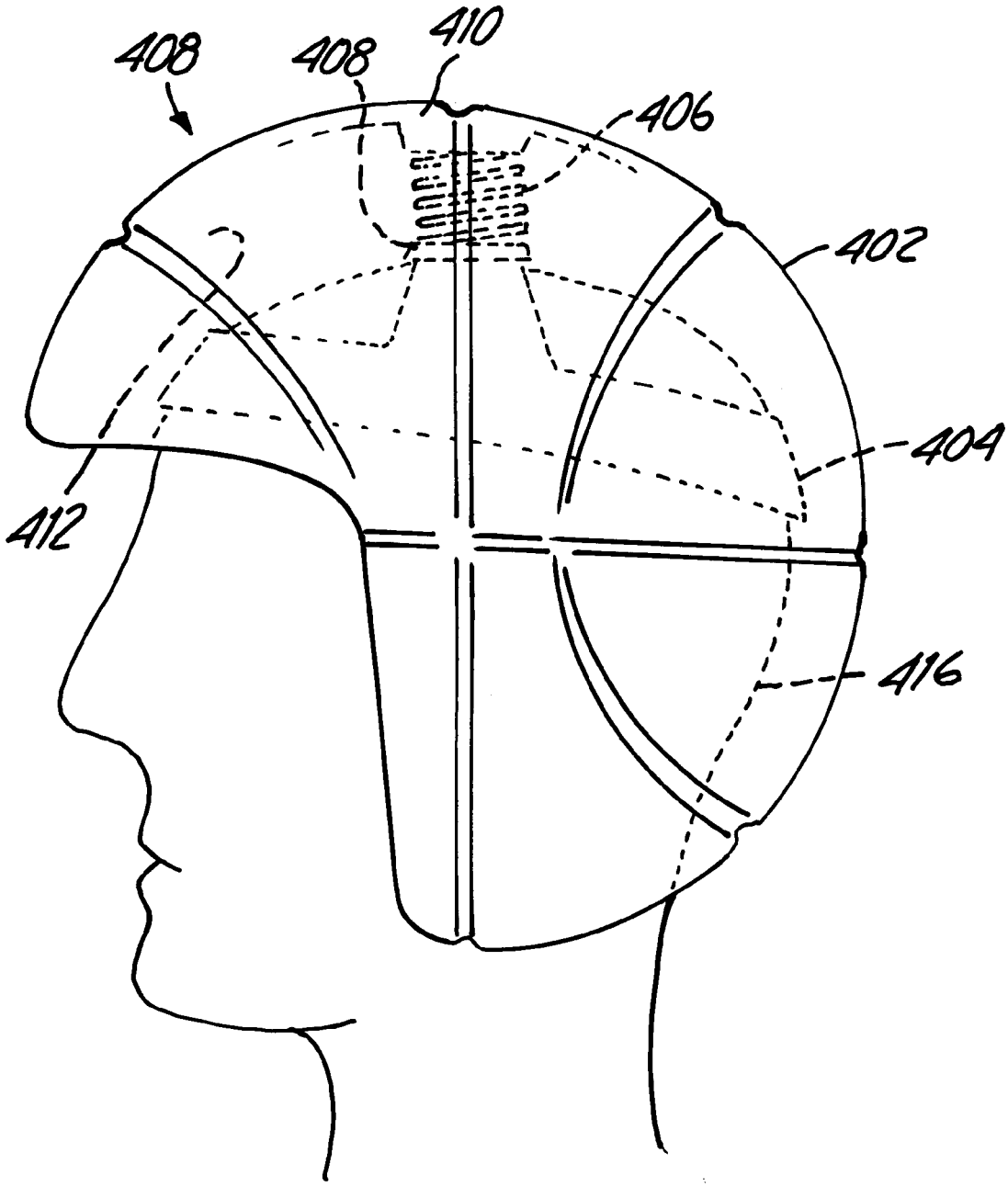
FIG. 4 is a side elevational view of a headpiece in accordance with an embodiment of the present invention.

Turning to FIG. 4, a side elevational view of a headpiece 400 illustratively positioned upon a head 416, in accordance with another embodiment of the present invention is illustrated. Similar numbers are used in FIG. 4 for elements that are the same or similar to elements illustrated in the previously described embodiments. Headpiece 400 includes a display member 402, head strap 404, action mechanism 406, optional molded elements 408 and 410, and inner concave portion 412, which are similar to comparable items in the previously described embodiments. In accordance with the FIG. 4 embodiment, display member 402 is formed as having the appearance of a basketball head (a cutaway basketball). It should be pointed out that while action mechanism 406 is depicted as a spring, other configurations, several examples of which are described in relation to FIG. 1, should be considered within the scope of the present invention. The display members depicted in FIGS. 3 and 4 should be considered only examples of the many potential display member forms.

Figure 5:
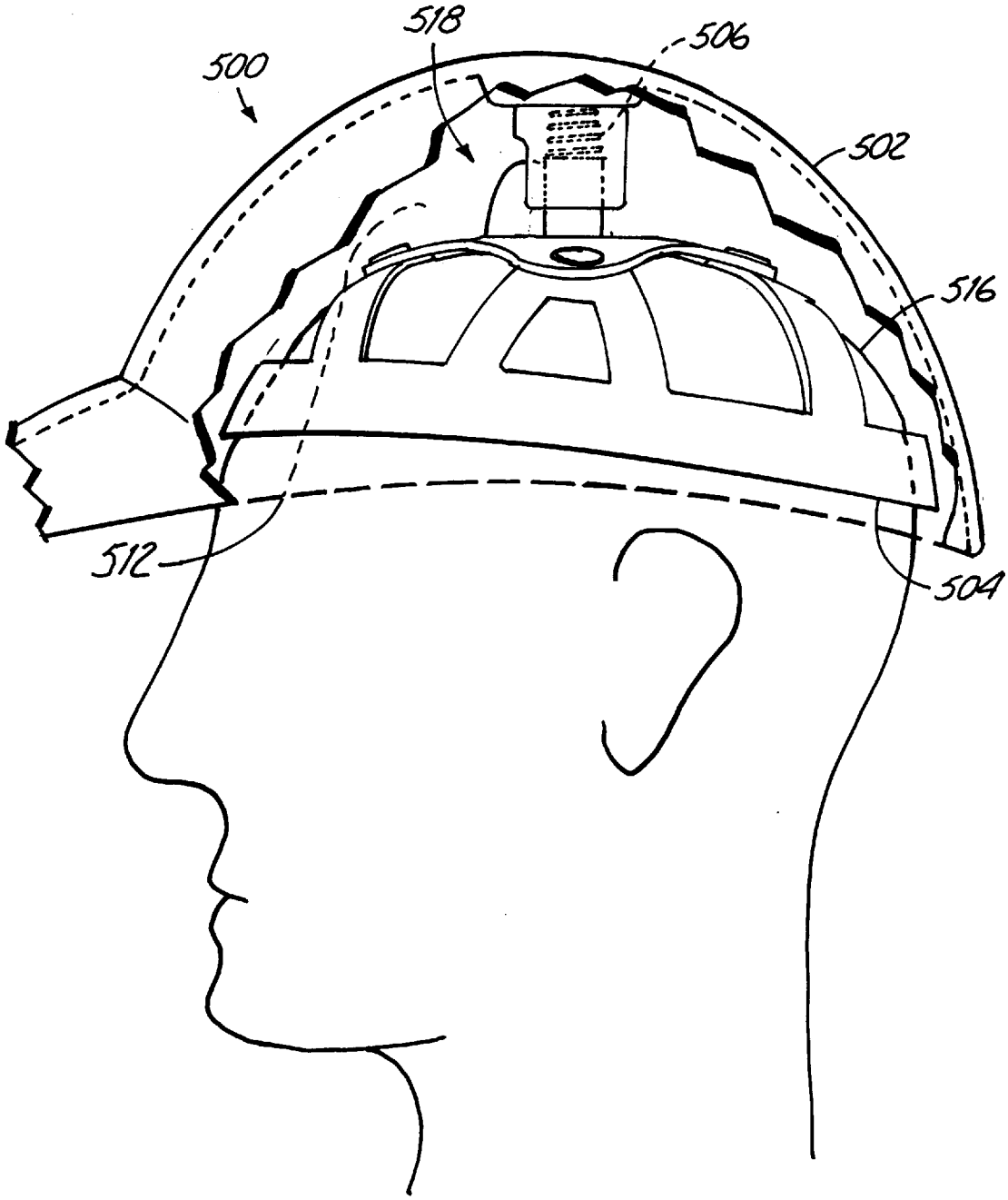
FIG. 5 is a side elevational view, partially broken away, of a headpiece in accordance with an embodiment of the present invention.

Turning to FIG. 5, a side elevational view of a headpiece 500 illustratively positioned upon a head 516, in accordance with another embodiment of the present invention. Headpiece 500 is partially broken away to illustratively reveal internal components. Similar numbers are used in FIG. 5 for elements that are the same or similar to elements illustrated in the previously described embodiments. Headpiece 500 includes a display member 502, head strap 504 and action mechanism 506. Headpiece 500 also includes a motion regulation assembly 518 for mechanically regulating motion of display member 502 relative to head strap 504.

Figure 6:
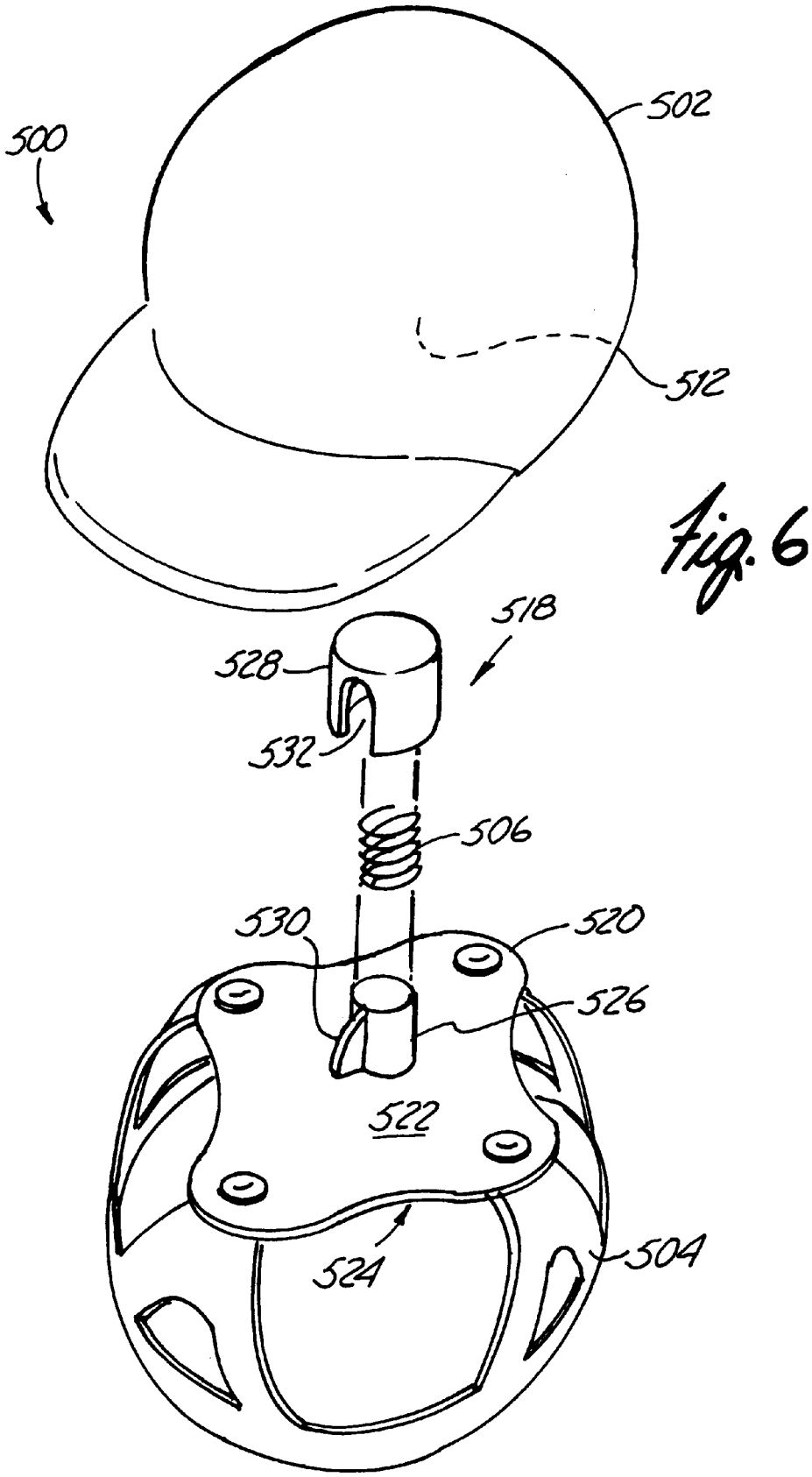
FIG. 6 is an isometric exploded view of the headpiece of FIG. 5.

Turning to FIG. 6, an isometric exploded view of the headpiece of FIG. 5 is illustrated and more clearly shows the components of motion regulation assembly 518. Motion regulation assembly 518 includes a connecting member 520 having a top surface 522 and a bottom surface 524. Head strap 504 is connected to bottom surface 524 and a first connection piece 526 is connected to top surface 522. A second connection piece 528 slidably receives first connection piece 526. Action mechanism 506 is operably disposed and secured between first connection piece 526 and second connection piece 528. The second connection piece is connected to inner concave portion 512 of display member 502.

Illustratively, motion regulation assembly 518 allows for, but limits the extent of, wobbling, bouncing or other similar motion of display member 502 relative to head strap 504. Motion regulation assembly 518 limits lateral motion of display member 502 relative to head strap 504.

In accordance with one embodiment, first connection piece 526 includes an extending element 530 that is slidably received within a slot 532 formed in second connection piece 528. Illustratively, slot 532 can be desirably sized to enable a desired range of motion for extending element 530 within slot 532, and a corresponding range of motion for display member 502 relative to head strap 504.

Figure 7:
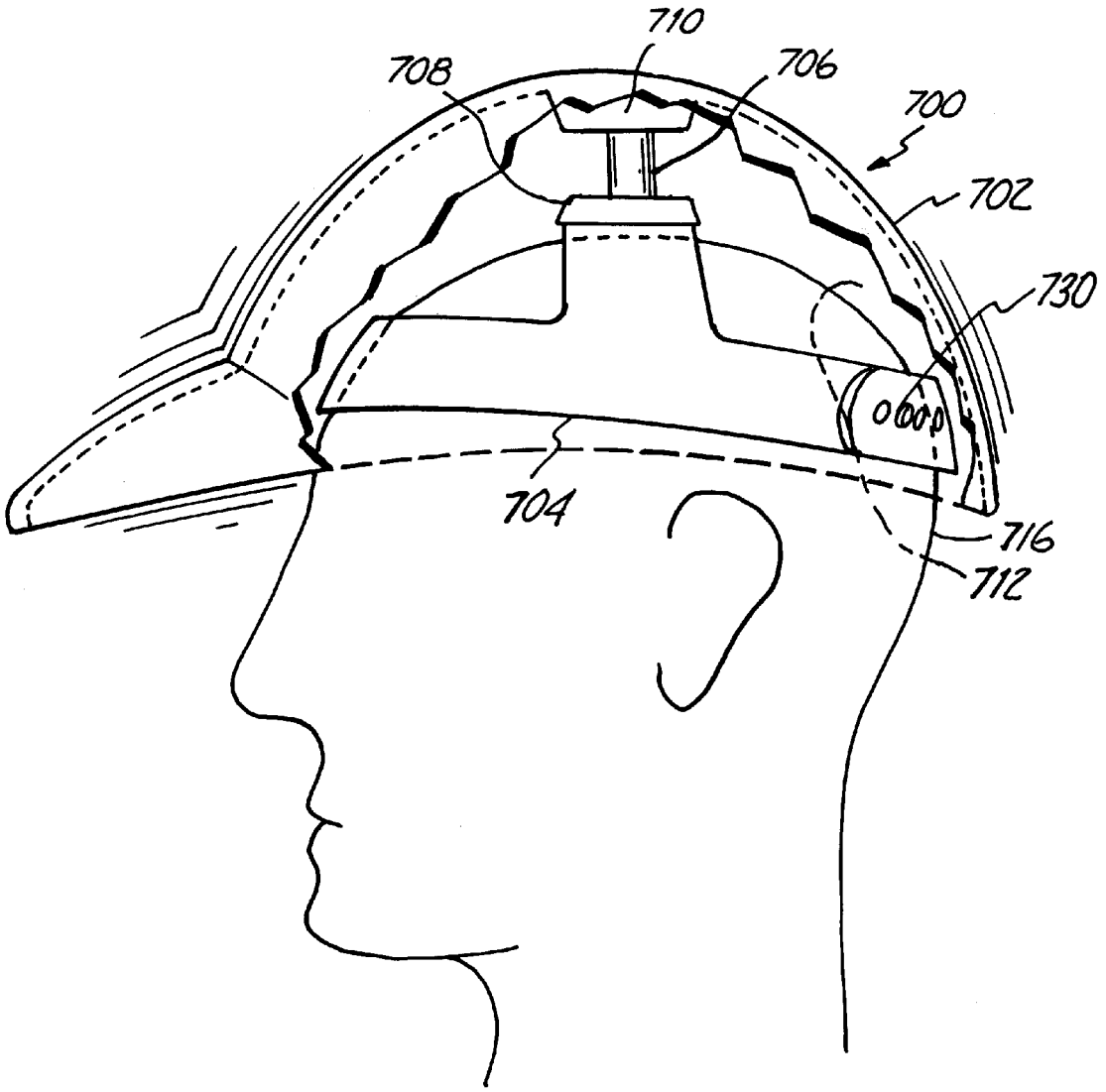
FIG. 7 is a side elevational view of an assembled headpiece in accordance with an embodiment of the present invention.

FIG. 7 is a side elevational view of an assembled headpiece 700 in accordance with an embodiment of the present invention. The illustrated headpiece 700 is illustratively partially broken away to expose components of the present invention. Similar numbers are used in FIG. 7 for elements that are the same or similar to elements illustrated in the previously described embodiments. Headpiece 700 is illustratively shown being worn on a head 716.

Headpiece 700 includes a display member 702 connected to a head strap 704 by an action mechanism 706. Display member 702 includes a concave portion 712 that substantially surrounds and is substantially disassociated from head strap 704. Display member 702 and head strap 704 respectively include optional molded elements 710 and 708 for receiving and supporting portions of action mechanism 706. In accordance with an embodiment of the present invention, when head 716 is moved, display member 702 is caused to wobble/bounce relative to head strap 704 and head 716.

It should be pointed out that while display member 702 is depicted as having the appearance of a baseball helmet, other configurations, several examples of which are described in relation to the previously described Figures, should be considered within the scope of the present invention. Also, in previously described Figures, the action mechanism is illustrated as being a spring. In FIG. 7, however, action mechanism 706 is illustrated as being a piece of flexible material that illustratively performs a function similar to the previously described and illustrated springs. Action mechanism 706 can illustratively be constructed all or in part of a flexible material such as rubber, a sponge material, a sponge-like material, flexible wood, flexible polymeric material or a flexible metal material. In accordance with one embodiment, as is illustrated in FIG. 7, head strap 704 includes a size adjustment mechanism 730. Size adjustment mechanism is illustrated as being a size adjustment mechanism of a ball cap-type, such as is known in the art. Other size adjustment mechanisms, however, should be considered within the scope of the present invention.

Although the present invention has been described with reference to preferred embodiments, workers skilled in the art will recognize that changes may be made in form and detail without departing from the spirit and scope of the invention.

What is claimed is:

1. A wobbling headpiece, comprising:

a head strap;

a display member having an inner concave portion that substantially surrounds the head strap, wherein the display member and the head strap are substantially disassociated from one another;

an action mechanism operably disposed between the display member and the head strap; and an actuator configured to move the display member relative to the head strap.

2. The headpiece of claim 1, wherein:

the head strap includes a connecting member and a head engaging portion; and the action mechanism inter connects the inner concave portion of the display member and the connecting member of the head strap.

3. The headpiece of claim 1, wherein the head strap further includes a size adjustment mechanism.

4. The head piece of claim 1, wherein the action mechanism is integrally formed with the display member.

5. The headpiece of claim 1, wherein the action mechanism is a spring.

6. The headpiece of claim 1, wherein the action mechanism is all or in part constructed of a flexible material selected from the group consisting of rubber, sponge material, flexible wood, flexible polymeric material and metal.

7. The headpiece of claim 1, wherein the display member has the appearance of a helmet.

8. The headpiece of claim 1, wherein the action mechanism is integrally formed with the head strap.

9. A headpiece comprising:

a connecting member having a top surface;

a head strap connected to the connecting member;

a first connection piece connected to and extending from the top surface of the connecting member;

a display member having an inner concave portion that substantially surrounds and is substantially dissociated from the head strap and the connecting member;

a second connection piece that slidably receives the first connection piece and is connected to the display member; and an action mechanism operably disposed between the first and second connection pieces.

10. The headpiece of claim 9, wherein the action mechanism is integrally formed with one of the first and second connection pieces.

11. The headpiece of claim 10, wherein:

the first connection piece includes an extending element; and the second connection piece includes a slot for slidably receiving the extending element.

12. The headpiece of claim 10, wherein the head strap includes a size adjustment mechanism.

13. The headpiece of claim 10, further comprising an actuator configured to move the helmet portion relative to the head strap.

14. The headpiece of claim 10, wherein the action mechanism is a spring.

15. The headpiece of claim 10, wherein the action mechanism is constructed of a sponge material.

16. The headpiece of claim 10, wherein the action mechanism is constructed of a rubber material.

17. The headpiece of claim 10, where in the action mechanism is constructed of a flexible wood material.

18. A novelty headpiece, comprising:

a display member having the appearance of an oversized helmet;

a head strap; and an action mechanism operably disposed between the display member and the head strap, the action mechanism being configured to encourage and facilitate a wobbling movement of the display member relative to the head strap, wherein the head strap is configured to engage the head of a wearer and the action mechanism is further configured to encourage and facilitate the wobbling movement whenever the head of the wearer is moved.

19. The novelty headpiece of claim 18, further comprising an actuator configured to move the display member relative to the head strap.

* * * * *